US005725115A

United States Patent [19]

Bösl et al.

[11] Patent Number: 5,725,115

[45] Date of Patent: Mar. 10, 1998

[54] CLOSURE CAP WITH TETHER

[75] Inventors: Udo Bösl, Eimeldingen; Michael Kirchgessner, Egringen, both of Germany

[73] Assignee: Crown Cork AG, Reinach, Switzerland

[21] Appl. No.: 582,356

[22] Filed: Jan. 5, 1996

[30] Foreign Application Priority Data

Feb. 21, 1995 [CH] Switzerland ..... 502/95

[51] Int. Cl.[6] ..... B65D 41/32

[52] U.S. Cl. ..... 215/252; 215/258; 215/306

[58] Field of Search ..... 215/252, 258, 215/306

[56] References Cited

U.S. PATENT DOCUMENTS

| | | | |
|---|---|---|---|
| 2,961,009 | 11/1960 | Leach | 215/306 X |
| 3,904,062 | 9/1975 | Grussen | 215/252 |
| 4,805,792 | 2/1989 | Lecinski, Jr. | 215/253 |
| 5,215,204 | 6/1993 | Beck et al. | 215/252 |

FOREIGN PATENT DOCUMENTS

| | | |
|---|---|---|
| 0 612 668 A1 | 8/1994 | European Pat. Off. . |
| WO 94/14673 | 7/1994 | WIPO . |

*Primary Examiner*—Stephen Cronin

*Attorney, Agent, or Firm*—Woodcock Washburn Kurtz Mackiewicz & Norris LLP

[57] ABSTRACT

A closure cap that is connected captively with the neck of a container. To this end, a retaining ring is used to engage beneath a bead on the container mouth when the cap is in position on the container mouth. The cap wall is firmly connected with this retaining ring by the tether. The retaining ring at the same time serves as an anti-tamper security for the closure. In its original condition, the tether runs between the cap wall and the retaining ring along the circumference of the closure cap and is connected by nominal rupture bridge pieces not only with the retaining ring but also with the lower edge of the cap wall. In order to avoid the risk of destruction of these nominal rupture bridge pieces during fitting of the closure cap, and at the same time ensure that the retaining ring holds firmly to the container mouth with the closure cap in position on the container mouth, the retaining ring is equipped with a plurality of tongues protruding radially inwards from its inner surface, the tongues being aligned upwards towards the cap base and engaging beneath the bead on the container mouth when the closure cap is in position on the container mouth.

11 Claims, 5 Drawing Sheets

CLOSURE CAP WITH TETHER

BACKGROUND OF THE INVENTION

The invention concerns a tethered closure cap. Arranged on the lower edge of the cap wall of closure caps of this type is a retaining ring that engages beneath a bead on the container mouth when the closure cap is in position. On opening the container, only the upper cap portion is removed, while the lower retaining ring remains firmly connected to the container mouth. A longitudinal tether connects the retaining ring with the lower edge of the cap wall so that the cap will remain connected with the container and cannot be mislaid, also after the container has been opened.

As a rule, such tethers are used in order to connect screw closures to the container so that they cannot be mislaid. However, other types of closure cap, such as snap closures, can be provided with a tether in order to avoid loss of the closure cap. By means of the tether, the risk of injury associated with pressing off the closure cap will, at the same time, be considerably reduced. In the case of a screw cap, such a situation can arise, for example, when the cap is mistakenly turned in the wrong direction when opening the container, thus causing the thread to jump. If the container is under pressure, such as is the case with beverages containing carbon dioxide, for example, the closure cap can be forced directly off the container mouth when the thread jumps. Because of the tether, however, the closure cap cannot fly off or will at least be restricted in its acceleration, even if the tether should tear. The risk of injury will thus be clearly reduced.

The longer the tether, the easier that the removable cap portion can be moved from the area of the mouth orifice when opening the container, so that handling of the container, for example during pouring of the container contents, will not be impeded. Apart from that, in the case of screw caps, a certain length to the tether is required in order to anyway permit opening of the container, since the screw cap must be moved vertically upwards during opening. The tether is so arranged that, with the closure cap in position on the container, said tether will run along the circumference between the cap wall and the retaining ring. With this arrangement, the maximun length of the tether will be limited by the circumference of the closure cap.

The retaining ring is simultaneously used as an anti-tamper ring for the display of initial opening of the container. To this end, the retaining ring is connected by means of nominal rupture bridge pieces with the lower edge of the cap wall. These nominal rupture bridge pieces will be destroyed on opening the container for first time, so that prior opening of the container will be visible from outside. To this end, provision is made in the area of the tether for preferably two rows of nominal rupture bridge pieces, a first row between the retaining ring and the lower edge of the tether, and a second row of nominal rupture bridge pieces between the upper edge of the tether and the lower edge of the cap wall. As a rule, the tether possesses an upper and a lower lateral surface, the upper lateral surface being connected with the lower edge of the cap wall by means of nominal rupture bridge pieces, and the lower lateral surface being connected by means of nominal rupture bridge pieces with the retaining ring. Normally, the tether is of uniform height along its entire length, and the lateral surfaces are gently inclined only in the radial direction in order to facilitate removal of the closure cap from the mold during manufacture.

DE-A1-24 30 775 shows a captive bottle cap of the aforementioned type. The cap comprises a screw-threaded upper portion and a lower collar, said collar engaging beneath a bead on the container mouth. The upper threaded portion of the cap is connected with the lower collar by means of an easily tearable, cylindrical tongue. This tongue extends around the entire circumference and is connected by means of two rows of connecting teeth with the upper portion and the lower collar. This cylindrical tongue is interrupted at one circumferential position so that it obtains two ends, of which one end is connected firmly to the screw-threaded portion of the cap and the other is connected firmly with the lower collar (retaining ring). The upper portion of the cap cannot therefore be mislaid, since the lower collar is held firmly on the container.

Closure caps with a tether are frequently used in place of the commonly used standard closure caps for the closure of container types that have long been state of the art. The construction and dimensions of the tethered closure cap is therefore in principle dictated by such state of the art container types. This in particular also applies to the procedure for placing the closure cap on the container, wherein the anti-tamper strip and, as in the case in question, the retaining ring must be pressed over either a bead, individual protrusions or other retaining elements. Because of the given dimensions of the retaining ring, with state of the art closure caps with a tether, the risk is not to be discounted that the retaining ring can be pushed over the bead on the container mouth when opening the container for the first time and removed from the container, along with the upper portion of the cap. There is therefore a risk that the function of the retaining ring is not reliably ensured, both in relation to the anti-tamper function, and the retaining function in combination with the tether. A further problem is the additional nominal rupture line arising through the arrangement of the tether between the retaining ring and the lower edge of the cap wall. The generally known risk with anti-tamper rings of breakage of the nominal rupture bridge pieces when screwing on the cap for the first time will, with that, be additionally increased.

SUMMARY OF THE INVENTION

It is a purpose of the invention to create a closure cap with a retaining ring and a tether, the retaining ring of said cap being able to slide over the bead on the container mouth on initial fitting of the closure cap without risk to the nominal rupture bridge pieces, and subsequently holding securely on the container mouth. According to the invention, this purpose is fulfilled by a closure cap possessing the following features.

The retaining ring of such a closure cap possesses a plurality of tongues protruding radially inwardly on its inside surface, said tongues being aligned towards the cap base and engaging beneath the bead on the container mouth when the closure cap is in position on the container mouth. These tongues are connected only at one end with the retaining ring, and their free end is able to pivot in a radial direction in relation to the anti-tamper strip. On initial fitting of the closure cap, these tongues can therefore be pivoted outwards in the radial direction when they slide over the bead onto the container mouth. The loads thus arising on the retaining ring, and on the tearable connection of said retaining ring with the cap wall, can in this way be considerably reduced.

Also in relation to the retaining function, these tongues have an advantage over state of the art retaining elements used in combination with tethers and rigidly connected with the retaining ring. If the closure cap of a container is lifted, the retaining elements of the retaining ring will be pressed against the bead on the container mouth, and this will lead to loading and deformation of the retaining ring. This is particularly pronounced with closure caps with a tether since the retaining ring of these closure caps possesses a relatively slight height. In particular, the load on the retaining elements will impart a cross-sectional rotation to the ring, and in the case of retaining elements connected rigidly to the retaining ring, this will lead to said retaining elements tilting away downwards to thus release the retaining ring, or at least assist the retaining ring to slip off. Although inwardly directed tongues will also not completely prevent deformation of the retaining ring, the tongues do have the advantage that their free end can, to a considerable degree, move independently in relation to the retaining ring, so that the tongues will then securely take up a position against the bead when the retaining ring is subjected to deformation.

In order to obtain sufficient space for the tether with the least possible constructional height, preferably a retaining ring is used, the vertical height of which at the most amounts to three times its radial thickness. A retaining ring with such a low cross section will indeed have the disadvantage that it will deform more easily. Nevertheless, by using the aforementioned retaining elements in the form of tongues protruding radially inwards, the anti-tamper function can be reliably ensured. Through a further reduction of the height of the retaining ring, additional savings in material can be made and at the same time more space for the arrangement of the tether can be created. Particularly preferred, therefore, is the use of a retaining ring, the vertical height of which amounts, at most, to double its radial thickness in the area of the tether. Even a retaining ring with an approximately square cross section is reliably held on the container mouth by means of the inwardly aligned tongues, and the corresponding low constructional shape of the retaining ring on the one hand permits savings in material and, on the other hand, more space for the tether arrangement.

A further advantage of the low constructional shape of the retaining ring is that, with the closure cap in position, the tongues directed towards the cap base can extend upwards beyond the upper edge of the retaining ring. By means of a suitable dimension and arrangement of the tongues, an arrangement is even possible wherein the tongues, pointing steeply upwards, extend upwards beyond the lower lateral surface of the tether arranged around the cap circumference. During initial fitting of the closure cap on the container mouth, a steeply upwardly oriented position is assumed by the tongues as they slide over the bead on the container mouth. With that, they will be pressed radially outwards by the bead. If the tongues extend into the area of the tether, this will have the advantage that the tongues will make contact on the inside surface of the tether during the critical phase of the screwing-on procedure when they slide over the bead on the container mouth. In the case of screw caps, the maximum load on the nominal rupture bridge pieces will arise in this critical phase, since the retaining ring is subjected to a braking effect by the tongues making contact with the bead on the container mouth, and with that must transmit a relatively high torque from the cap wall to the retaining ring. In making contact on the inside of the tether, the said tongues will bridge the gap between the tether and the retaining ring and thus relieve the nominal rupture bridge pieces arranged between these two elements, since a portion of the torque is transmitted via the tongues themselves.

The tongues can be arranged along the retaining ring in various ways. In particular, the distance between adjacently arranged tongues can be selected differently. With one of the preferred embodiments of the invention, the tongues are arranged tightly adjacent along the retaining ring. The lateral edges of the adjacently arranged tongues are, with that, connected by a flexible bridge of material acting as a linkage. A longitudinal tongue strip comprising a plurality of tongues will thus arise, and the tongues will in this case be mutually held in their respective positions so that they can no longer be pivoted with such ease. This is of advantage when the closure cap is cast in a shape wherein the tongues are directed downwards, away from the cap base. This position of the tongues is preferred when casting the closure caps because this shape for the cap will then facilitate removal from the mold after casting. However, the tongues must subsequently be pivoted inwards from their downwardly aligned position, and this is preferably carried out in a separate working step, prior to fitting of the closure cap onto the container mouth. Basically, however, the tongues will tend to return to their original cast position. One possibility of avoiding such a situation is to now connect the adjacent tongues with one another as has been described in the above.

The tongues will therefore mutually hold themselves in their inner position, directed towards the cap base.

If individual tongues are used, arranged at a distance from one another, these can be fixed in their position aligned towards the cap base in another way, for example by a brief application of heat after pivoting into this position. A possible further alternative is, by means of the container mouth, to directly pivot the tongues inwards during fitting of the closure cap. To this end, a specially designed container mouth is normally required, however.

BRIEF DESCRIPTION OF THE DRAWINGS

Examples and embodiments of the invention are more closely described in the following, illustrated by the drawings: namely, FIG. 1 a container mouth with closure cap in the unscrewed position.

DETAILED DESCRIPTION OF PREFERRED EMBODIMENT(S)

Figure 1:
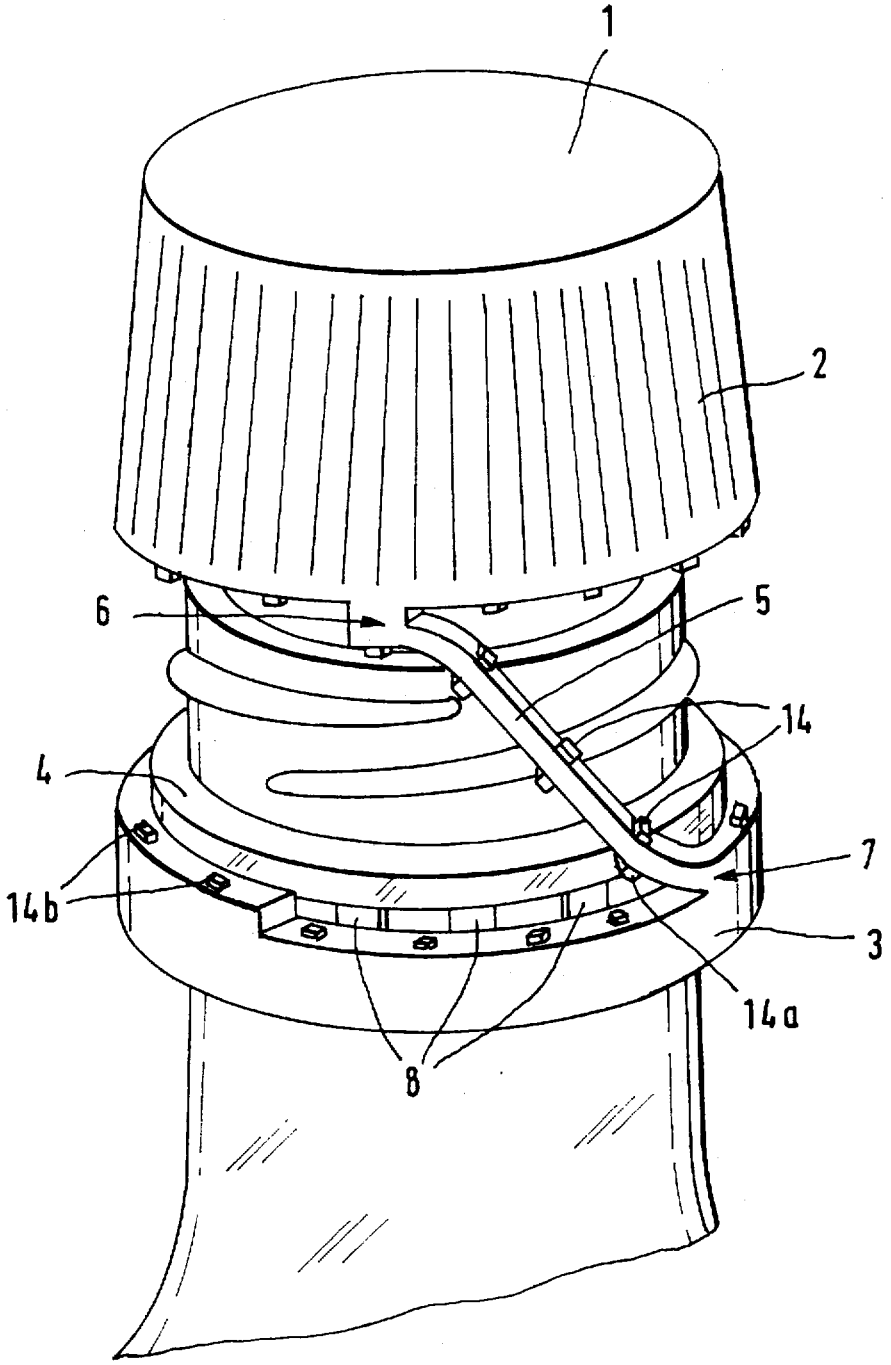

FIG. 1 shows a container mouth with a closure cap in the screwed-off position. The removable cap portion comprises a cap base 1 and an cap wall 2 abutting said cap base. The cap wall 2 is connected by means of a tether 5 with the retaining ring 3. The retaining ring 3 possesses on its inside surface tongues 8 that protrude radially inwards, said tongues engaging beneath a bead 4 on the container mouth. It is obvious that the screw cap cannot simply float into the position shown, but must be held by a hand not shown here. After opening, the screw cap is removed from the area of the container mouth and will then hang beneath the retaining ring 3 in a position not shown. One end 6 of the tether 5 is firmly connected with the lower edge of the cap wall 2 and the other end 7 is firmly connected with the retaining ring 7. Prior to tearing of the retaining ring, the tether runs around the circumference of the closure cap, between the cap wall and the retaining ring. The tether 5 shown here only extends around a portion of the cap circumference. The upper lateral surface of the tether 5 is connected by nominal rupture bridge pieces 14 with the lower edge of the cap wall, and the lower lateral surface of the tether 5 is connected with the retaining ring 3 by means of the nominal rupture bridge pieces 14*a*. Beyond the area of the tether, the retaining ring 3 is connected by nominal rupture bridge pieces 14*b* directly with the lower edge of the cap wall.

Figure 2:
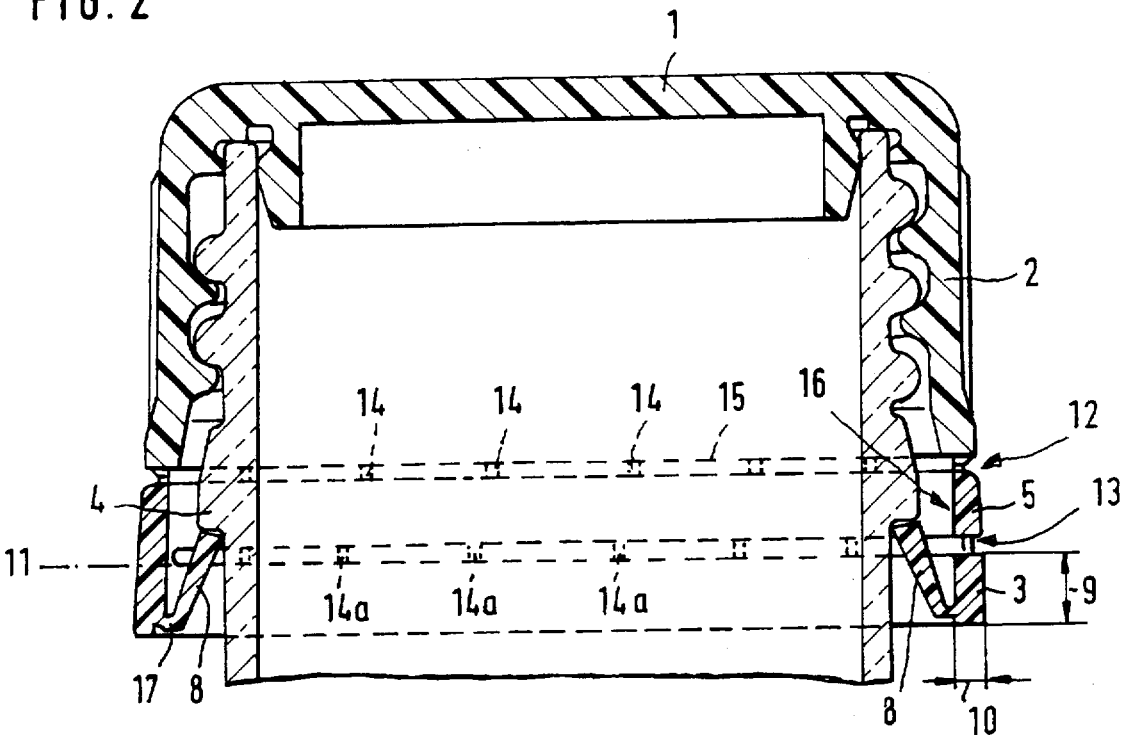
FIG. 2 a cross section of a container mouth with closure cap in position.

FIG. 2 shows a cross section of a container mouth with closure cap in position. The retaining ring 3 of this closure cap possesses a plurality of tongues 8 directed radially inwards towards the cap base 1, of which only two can be seen in this representation, however. These tongues engage beneath a bead 4 on the container mouth. The tongues 8 are connected with the retaining ring 3 only at one end by a linkage connection 17. This linkage connection 17 enables the free end of the tongues 8 to pivot in the radial direction and thus deflect outwards, in particular when fitting the closure cap for the first time when the free end will slide over a bead on the container mouth. The linkage connection 17 is preferably arranged on the lower edge of the retaining ring 3, although in principle it is also conceivable for the retaining ring to extend downwards beyond the connection point of the linkage connection 17.

A tether 5, possessing two approximately parallel lateral surfaces 13, is arranged between the retaining ring 3 and the cap wall 2. Both the lateral surfaces 12, 13 are normally gently inclined (not shown) toward each other in the radial direction only, in order to facilitate removal from the mold during manufacture. The upper lateral surface 12 of the tether 5 is connected by means of nominal rupture bridge pieces 14 with the lower edge 15 of the cap wall and the lower lateral surface 13 of the tether 5 is connected by nominal rupture bridge pieces 14*a* with the retaining ring 3. In the area of the tether 5, the vertical height 9 of the retaining ring 3 is less than three times its radial thickness 10. Through the slight height of the retaining ring 3, space is gained for the arrangement of the tether 5 between the retaining ring and the cap wall 2.

The tongues 8 extend upwards beyond the lower lateral surface 13 of the tether 5. If the tongues 8 are pressed radially outwards by a bead 4 on the container mouth when the closure cap is being fitted for the first time, they will thus make contact with the inside surface 16 of the tether 5, and this will lead to a relief of the load on the lower nominal rupture bridge pieces 14*a* connecting the tether 5 to the retaining ring 3.

Figure 3:
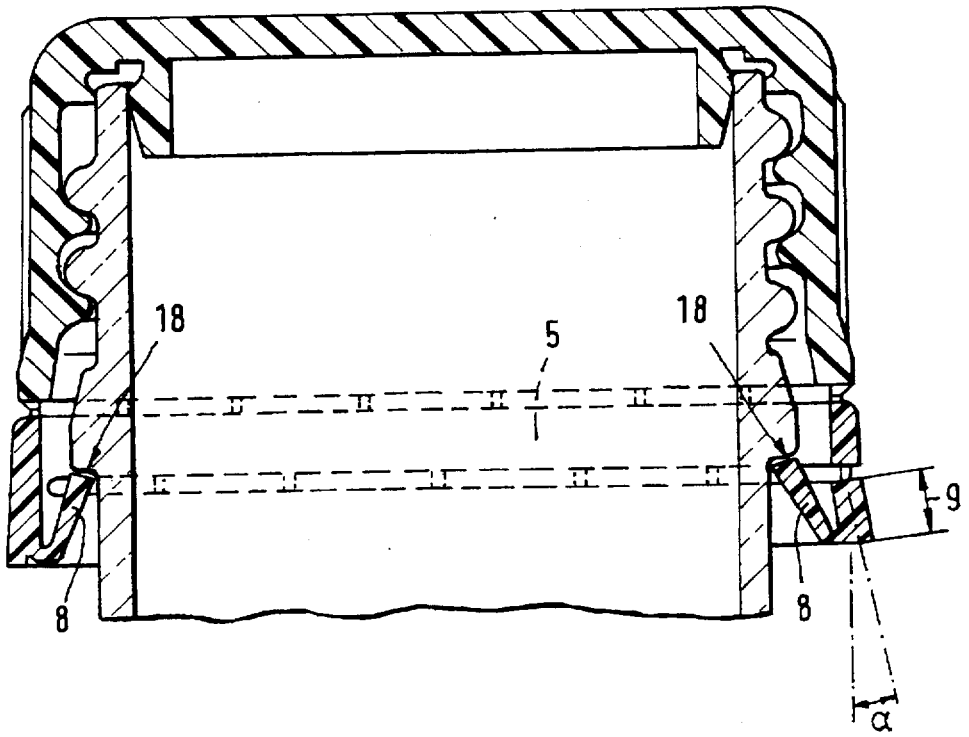
FIG. 3 the container mouth according to FIG. 2 at commencement of the opening sequence, FIG. 4 a side view of the closure cap with retaining ring and tether, FIG. 5 a cross section of a screw cap along the plane A—A in FIG. 6, FIG. 6 a horizontal section of the retaining ring of the screw cap shown in FIG. 5, through the plane B—B, FIG. 7 a cross section of the screw cap according to FIG. 5 with tongues directed downwards, and FIG. 8 a cross section of a further screw cap with a plurality of tongues arranged at a distance from one another.
Figure 4:
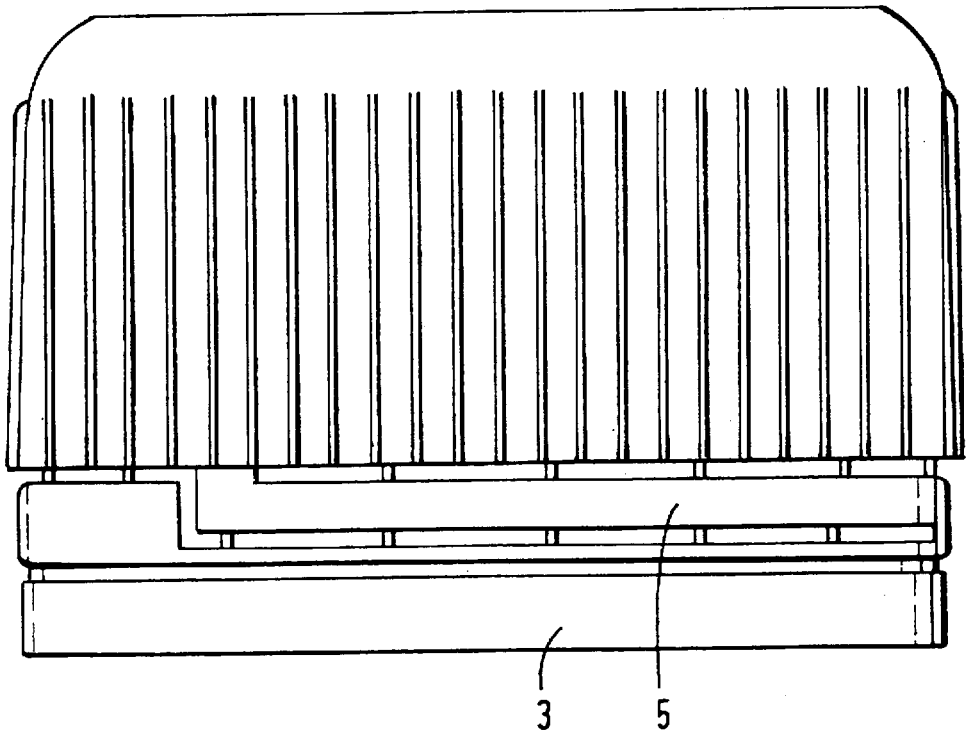

The relatively slight cross-sectional height 9 of the retaining ring 3 will lead to the retaining ring being deformed when load is applied to the tongues 8. This can be seen in FIG. 3, in which the container mouth according to FIG. 2 is shown at the commencement of the opening procedure. On screwing off the closure cap, the tongues 8 are placed under load by the force 18. This force 18 takes effect on the retaining ring 3 which, because of its relatively slight cross-sectional height 9, will rotate especially in the area of the tether 5 and be bent outwards. The cross-sectional rotation of the retaining ring through the angle $\alpha$ would, with retaining elements connected firmly to the retaining ring 3, lead to said retaining elements being pivoted away downwards. Through the use of the movable tongues 8, this can be effectively hindered so that the retaining ring 3 is reliably held on the container mouth in spite of its relatively slight ring cross section. In FIG. 4, a side view of a closure cap is shown with retaining ring 3 and tether 5. With this embodiment, too, the tether 5 extends solely over a partial area of the circumference of the cap. Basically, a longer tether could also be used, however, extending practically around the entire circumference of the closure cap.

Figure 5:
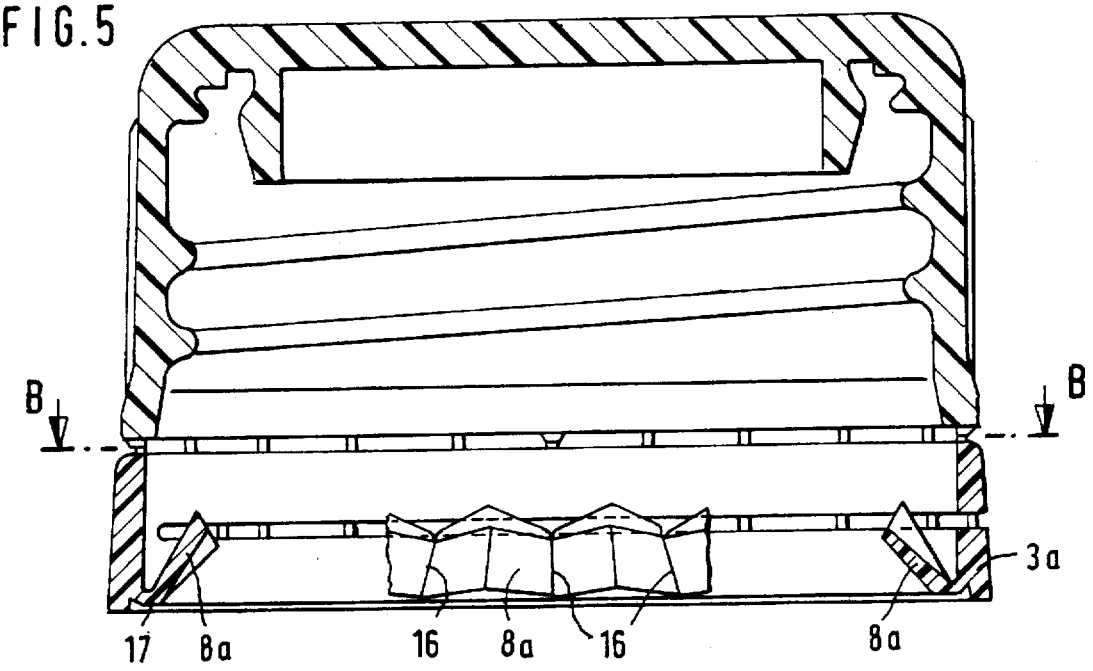
Figure 6:
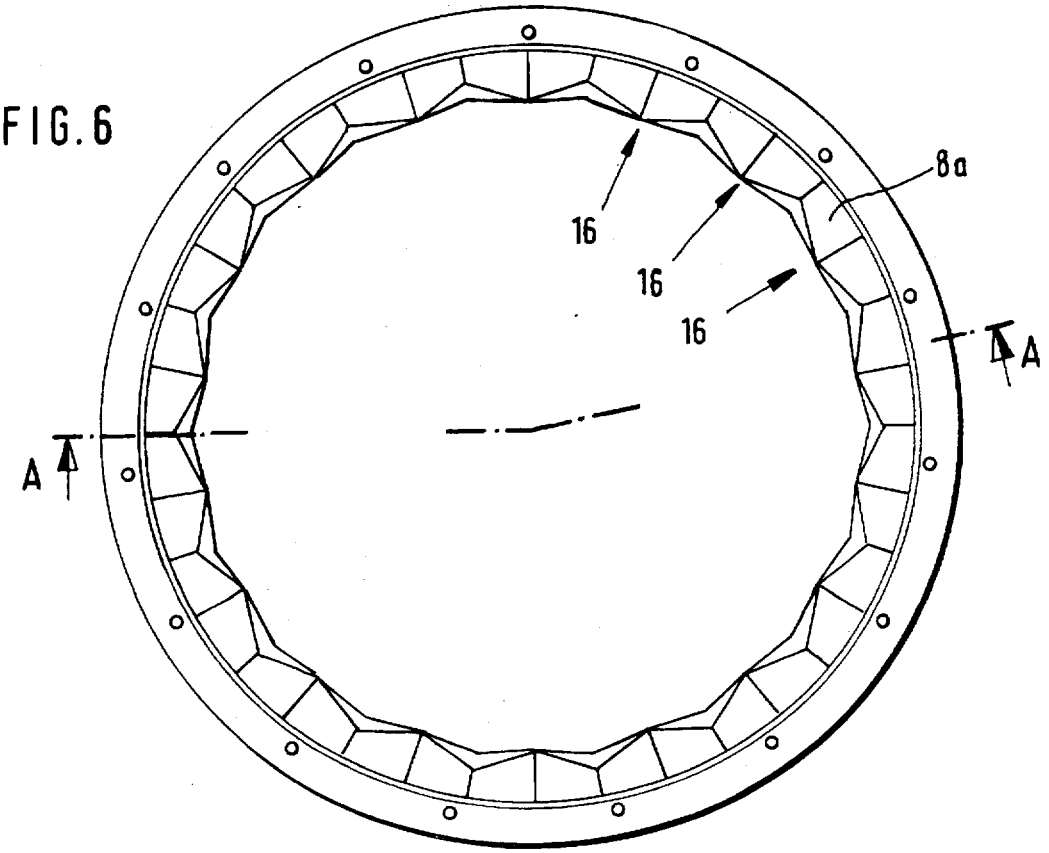

In FIG. 5, a cross section of a screw cap according to the section through,the plane A—A in FIG. 6 is shown. The tongues 8*a* shown in this embodiment are symmetrically folded inwards at the centre of the tongue, thus granting them greater resistance to pressure compared with flat tongues. The tongues 8*a* are arranged to be tightly adjacent and are connected by flexible bridge pieces of material 16 to form a circumferential, inner tongue strip. This is also easily recognisable in FIG. 6, in which the retaining ring of the screw cap shown in FIG. 5 is shown from above, according to the sectional plane B—B. The connecting bridge pieces 16 can, however, be foregone, so that the adjacently arranged tongues are independent from one another.

Figure 7:
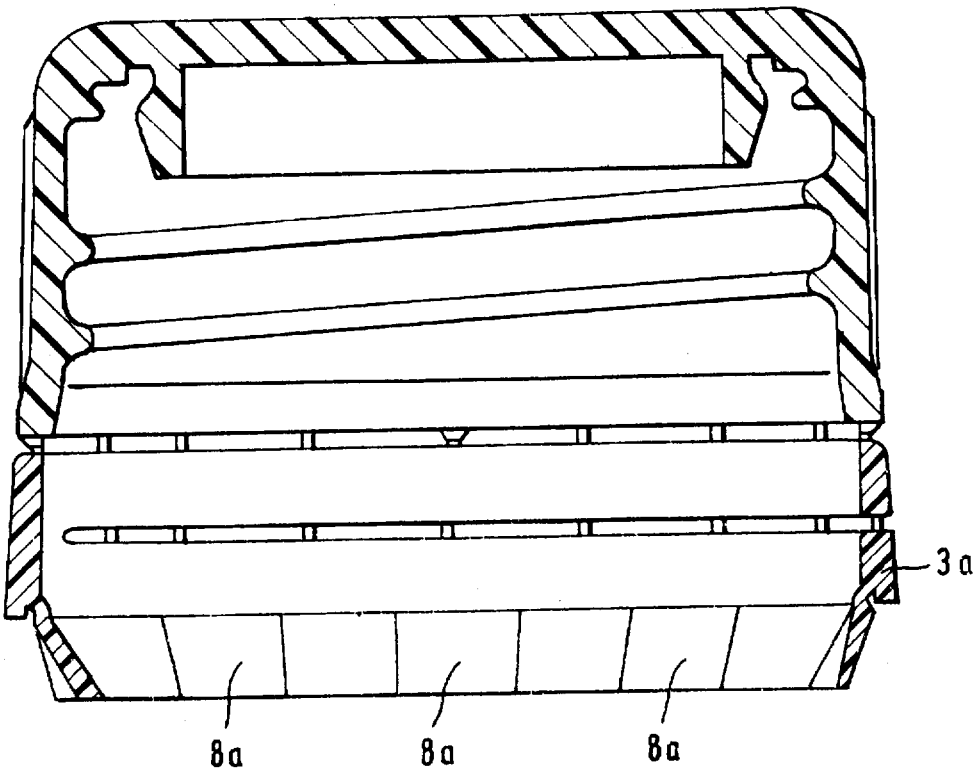

FIG. 7 shows the screw cap already shown in FIG. 5 with tongues directed downwards, away from the cap base. The tongues are preferably cast in this position and subsequently folded into their inner position, directed towards the cap base. In this respect, it is advantageous if the tongues are arranged tightly adjacent, as shown in this example. After pivoting inwards, such tightly adjacent tongues can mutually maintain this position. If the tongues were arranged at a greater distance from one another, they would tend to return to their original downward-pointing position (as created through casting). This can be avoided in a particularly effective way if the lateral edges of the adjacently arranged tongues are connected together by a flexible material 16 in the form of a linkage (FIG. 5).

Figure 8:
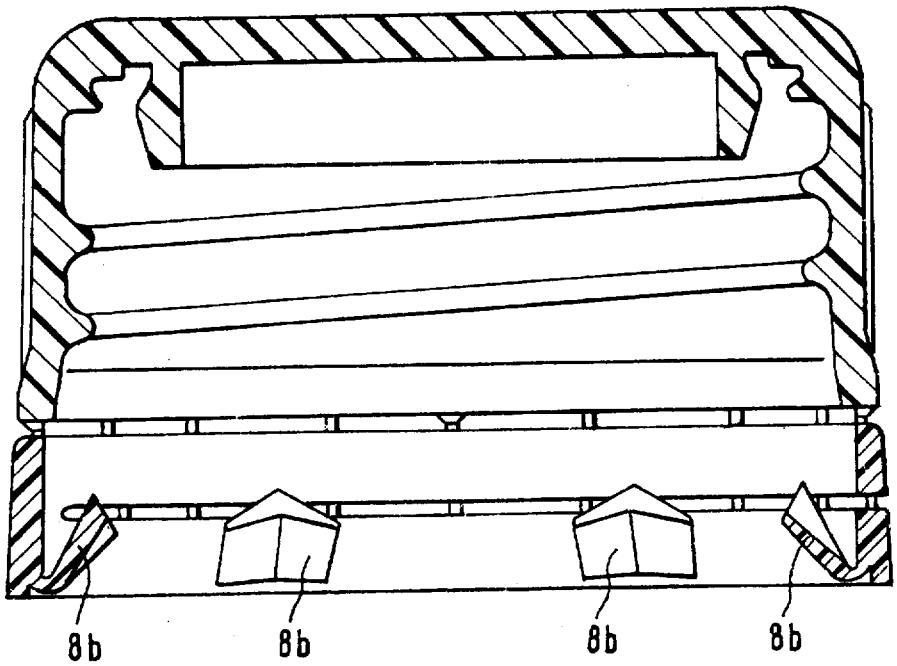

FIG. 8 shows the cross section of an alternative embodiment wherein the individual tongues 8*b* are arranged to be distributed at equal distance along the circumference of the anti-tamper ring. The tongues 8*b* can be cast either in the position shown or in a downwards position similar to FIG. 7, subsequently having to be folded inwards prior to fitting the closure cap. With the example shown here, only six tongues are arranged around the circumference. Preferably, a greater number of tongues are used, said tongues then being correspondingly more densely distributed around the circumference, in other words at lesser distances.

Inasmuch as the invention is subject to modifications and variations, the foregoing description and accompanying drawings should not be regarded as limiting the invention, which is defined by the following claims and various combinations thereof.

What is claimed:

1. Closure cap for the closure of a container mouth, the closure comprising:

a cap base;

a cap wall abutting said cap base;

a retaining ring being arranged on the lower edge of said cap wall, said retaining ring engaging beneath a retaining element when the closure cap is in position on the container mouth; and a tether, one end of said tether being connected firmly with the lower edge of the cap wall and the other end of said tether being connected firmly to the retaining ring, wherein the tether runs between the cap wall and the retaining ring along the circumference of the closure cap, characterized in that the retaining ring possesses on its inside surface a plurality of tongues protruding radially inwards, said tongues being directed upwards towards the cap base in order to engage beneath the retaining element on the container mouth and extending upwards beyond the upper edge of the retaining ring when the closure cap is in position on the container mouth.

2. Closure cap according to claim 1, characterized in that the tether is connected by nominal rupture bridge pieces with the lower edge of the cap wall.

3. Closure cap according to claim 1, characterized in that the tongues are arranged to be tightly adjacent along the retaining ring and the edges of the adjacently arranged tongues are connected together by a flexible material bridge piece acting as a linkage.

4. Closure cap according to claim 1, characterized in that the retaining ring is connected by means of nominal rupture bridge pieces with the lower edge of the cap wall.

5. Closure cap according to claim 1, characterized in that the retaining ring is connected by means of nominal rupture bridge pieces with the tether.

6. Closure cap according to claim 1, characterized in that the vertical height of the retaining ring amounts at the most to three times the radial thickness of said retaining ring.

7. Closure cap according to claim 6, characterized in that the retaining ring possesses an approximately square cross section.

8. Closure cap according to claim 1, characterized in that the retaining ring is connected by means of nominal rupture bridge pieces with the tether and the lower edge of the cap wall.

9. Closure cap according to claim 8, characterized in that the upwardly directed tongues extend upwards beyond the lower lateral surface of the tether arranged along the circumference of the cap so that, during fitting of the closure cap, said tongues are able to be pressed against the inside surface of the tether and the cap wall and with that at least partially cover the nominal bridge pieces.

10. Closure cap according to claim 8, characterized in that the upwardly directed tongues extend upwards beyond the lower lateral surface of the tether arranged along the circumference of the cap so that, during fitting of the closure cap, said tongues are able to be pressed against the inside surface of the cap wall and with that at least partially cover the nominal bridge pieces.

11. Closure cap according to claim 8, characterized in that the upwardly directed tongues extend upwards beyond the lower lateral surface of the tether arranged along the circumference of the cap so that, during fitting of the closure cap, said tongues are able to be pressed against the inside surface of the tether and with that is least partially cover the nominal bridge pieces.

* * * * *

UNITED STATES PATENT AND TRADEMARK OFFICE

CERTIFICATE OF CORRECTION

PATENT NO. : 5,725,115

DATED : March 10, 1998

INVENTOR(S) : Udo Bösl; Michael Kirchgessner

It is certified that error appears in the above-indentified patent and that said Letters Patent is hereby corrected as shown below:

Title page: [30] Foreign Application Priority Data, delete "502/95" and insert --502/95-0-- therefor.

Column 1, line 51, delete "container for first time" and insert -- container for the first time-- therefor.

Column 8, line 27, delete "and with that is least partially" and insert --and with that at least partially-- therefor.

Signed and Sealed this

Twenty-sixth Day of May, 1998

Bruce Lehman

*Attest:*

BRUCE LEHMAN

*Attesting Officer*

*Commissioner of Patents and Trademarks*